US008485405B2

(12) United States Patent
Crye

(10) Patent No.: US 8,485,405 B2
(45) Date of Patent: Jul. 16, 2013

(54) AMMUNITION MAGAZINE CARRYING DEVICE

(75) Inventor: Caleb Clark Crye, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 368 days.

(21) Appl. No.: 12/906,657

(22) Filed: Oct. 18, 2010

(65) Prior Publication Data

US 2012/0091173 A1 Apr. 19, 2012

(51) Int. Cl.
*A45F 5/00* (2006.01)

(52) U.S. Cl.
USPC ..... 224/666; 224/269; 224/251; 224/931

(58) Field of Classification Search
USPC ... 224/931, 269, 271, 666, 669, 251; D3/262; 24/614, 615
See application file for complete search history.

(56) References Cited

U.S. PATENT DOCUMENTS

| | | | | |
|---|---|---|---|---|
| 3,938,717 | A | 2/1976 | Theodore | |
| 4,809,894 | A * | 3/1989 | Viio | 224/248 |
| 5,174,482 | A | 12/1992 | Rogers et al. | |
| 5,676,241 | A * | 10/1997 | Degoix et al. | 206/3 |
| 6,000,589 | A | 12/1999 | Burdine | |
| 6,202,908 | B1 | 3/2001 | Groover | |
| 6,510,592 | B1 * | 1/2003 | Hamilton | 24/170 |
| 6,634,131 | B1 * | 10/2003 | Fitzpatrick | 42/90 |
| 7,025,238 | B2 | 4/2006 | Hughes et al. | |
| 7,464,447 | B2 * | 12/2008 | Khalifa et al. | 24/615 |
| 7,780,048 | B2 * | 8/2010 | Howell | 224/242 |
| 7,805,875 | B1 * | 10/2010 | Obong | 42/90 |
| 8,011,544 | B1 * | 9/2011 | Howell | 224/668 |
| 2004/0108346 | A1 * | 6/2004 | Pablo | 224/251 |
| 2004/0200111 | A1 | 10/2004 | Horn | |
| 2007/0278269 | A1 | 12/2007 | Rogers et al. | |
| 2008/0023509 | A1 | 1/2008 | Lowe | |
| 2008/0105722 | A1 | 5/2008 | Howell | |
| 2008/0277436 | A1 | 11/2008 | Wilson | |
| 2009/0307878 | A1 | 12/2009 | Kadas | |
| 2010/0072242 | A1 * | 3/2010 | Panosian et al. | 224/666 |

OTHER PUBLICATIONS

"Magpul® 5.56 NATO, 3 pack" http://store.magpul.com/product/MAG001/13 Downloaded Nov. 11, 2010.
"New from ITW Military Products: Magboot", Soldier Systems, http://soldiersystems.net/2010/01/30/new-from-itw-military-products/ Downloaded Nov. 11, 2010.

* cited by examiner

*Primary Examiner* — Justin Larson
(74) *Attorney, Agent, or Firm* — Stiennon & Stiennon

(57) ABSTRACT

A device for carrying an ammunition magazine has a band which encircles a conventional magazine and which has two downwardly extending plastic tabs. The two plastic tabs are spaced sidewardly to define an downwardly opening, downwardly extending gap, which permits the tabs to be received within openings in two adjacent loops presented by a standard MOLLE webbing on a Pouch Attachment Ladder System or PALS grid on a vest or other clothing item. The tabs are shaped to slide behind standard MOLLE webbing and engage the webbing to hold the magazine securely until the user grabs the magazine and pulls it away from the MOLLE webbing. The tabs are biased towards the magazine, and have a lower protrusion which engages beneath a belt, allowing the same device to be attached to a belt.

18 Claims, 5 Drawing Sheets

AMMUNITION MAGAZINE CARRYING DEVICE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for carrying ammunition magazines in the field.

Ammunition for automatic and semiautomatic weapons is typically loaded in spring-loaded containers or magazines which present multiple cartridges for rapid discharge from a rifle, shotgun, or pistol. A soldier, law enforcement officer, or sportsman can carry multiple magazines, making it possible to very rapidly replenish the ammunition of a weapon under time pressure.

Conventionally, ammunition magazines are carried in fabric pouches which are worn on belts or on vests. Yet these pouches remain attached to the user once the magazine has been removed, and, if provided with a covering flap, can interfere with the rapid removal of the magazine. Moreover, pouches may be limited in the variety of magazines which they can contain. Molded plastic attachments are known which fasten to the exterior of a magazine and which provide a clip for attaching the assembly to a belt.

What is needed is a device which permits an ammunition magazine to be alternatively attached to a belt or a conventional PALS vest which imposes a reduced weight burden on the user and which facilitates rapid access to and use of ammunition magazines.

SUMMARY OF THE INVENTION

The ammunition magazine carrying device of the present invention is fastenable to a conventional ammunition magazine, and has one or two downwardly extending tabs. If two tabs, they are spaced sidewardly to define an downwardly opening, downwardly extending gap or slot, which permits the tabs to be received within openings presented by two adjacent loops presented by a standard MOLLE webbing on a Pouch Attachment Ladder System or PALS grid on a vest, pack, or other clothing item. The tabs are shaped to slide behind standard MOLLE webbing and engage the webbing to hold the magazine securely until the user grabs the magazine and pulls it away from the MOLLE. This flexes the tabs and frees the magazine with ease. The attachment of the device to the MOLLE webbing or belt resists dislodging by physical activity of the user, while still allowing ready extraction of the device with attached magazine when needed. The tabs are biased toward the magazine, and may be provided with a lower protrusion positioned to engage beneath a conventional belt, allowing the same device alternatively to mount to a simple belt.

It is an object of the present invention to provide an attachment for an ammunition magazine to an article of clothing which is lightweight and low volume.

It is also an object of the present invention to provide a magazine carrying attachment device which does not substantially interfere with reloading of the magazine.

It is a further object of the present invention to provide a device for attaching an ammunition magazine to an article of clothing that leaves no portion on the article of clothing when the magazine is removed.

It is yet another object of the present invention to provide a device for attaching an ammunition magazine to a conventional MOLLE webbing or to a belt.

Further objects, features and advantages of the invention will be apparent from the following detailed description when taken in conjunction with the accompanying drawings.

DESCRIPTION OF THE PREFERRED EMBODIMENTS

Figure 1:
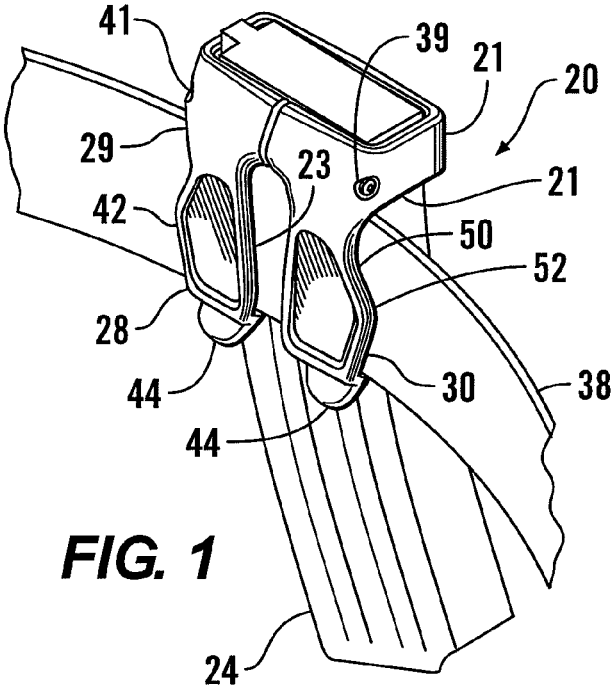
FIG. 1 is a rear perspective view of the ammunition magazine carrying device of this invention mounted to a conventional belt.
Figure 2:
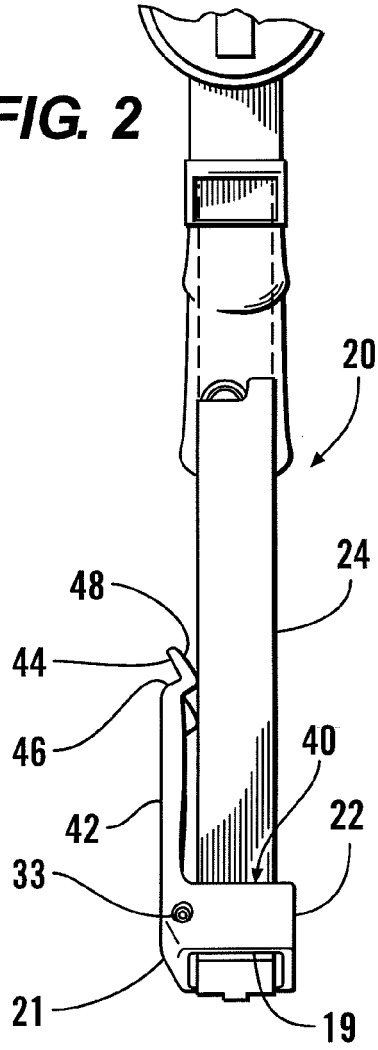
FIG. 2 is an exploded side elevational view of the device of FIG. 1 shown in relation to a rifle.
Figure 3:
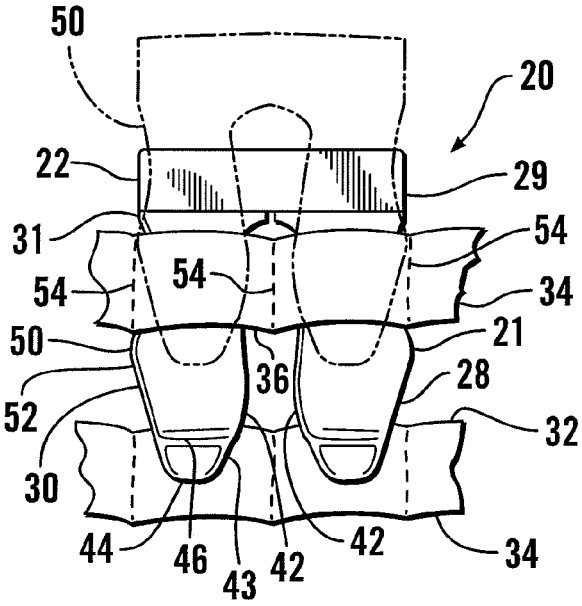
FIG. 3 is a front elevational view of the device of FIG. 1 shown engaged with a Pouch Attachment Ladder System vest, and shown in phantom view being inserted into the pouch loops.
Figure 4:
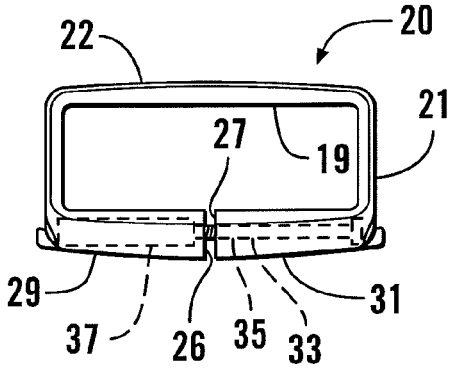
FIG. 4 is a top plan view of the device of FIG. 1.

Referring more particularly to FIGS. 1-12, wherein like numbers refer to similar parts, an ammunition magazine carrying device 20 is shown in FIGS. 1-4. The device 20 has a molded plastic body 21 with an upper element 22 which is sized to encircle and grip an ammunition magazine 24, as shown in FIGS. 1 and 4. The device 20 carries the magazine 24 when filled with rounds 25 of ammunition. A first tab 28 extends downwardly from the upper element, and a second tab 30, generally a mirror image of the first tab, extends downwardly from the upper element and is spaced sidewardly from the first tab to define a downwardly extending gap 23 between the first tab and the second tab. The plastic body 21 may be subjected to elevated temperatures and harsh solvents, so it is preferably formed of Nylon, or alternatively, a polyamide, a polycarbonate or ULTEM® amorphous thermoplastic polyetherimide resin, marketed by SABIC Innovative Plastics Holding BV.

The plastic upper element 22 of the device is a generally rectangular ring which is split to define a first end 26 which is spaced from a second end 27, as shown in FIG. 4. As shown in FIG. 2, the upper element defines an upper opening 19 and a lower opening 40, through which the magazine can extend or be accessed. The upper element 22 has a first portion 29 above the first tab 28, and a second portion 31 above the second tab 30. A fastener 33 such as an allen head screw extends through a horizontal bore 35 in the upper element 22 second portion 31 and extends into a receiving cylinder 37 which is coaxial with the bore 35. The receiving cylinder 37 is an internally threaded brass or stainless steel element which is secured by a press fit within a molded cavity in the first portion 29 of the upper element 22. By adjusting the fastener 33 the first portion is brought closer to the second portion 31, and the entire device is thereby clamped onto the lower portion of the magazine 24. Shallow recesses 39, 41 in the first portion 29 and the second portion 31 provide access to the receiving cylinder 37, and to the fastener 33.

The device 20 can be secured to a curved magazine with the magazine curving to the left or right. As left handed shooters will generally have the ammunition facing in the opposite direction of a right handed shooter, the device 20 allows for the user to place the magazine in a preferred orientation.

As shown in FIG. 3, each tab 28, 30, has a planar main segment 42 which is generally parallel to the magazine, and a terminating tab foot 44 which extends away from the magazine. As shown in FIG. 2, each tab foot 44 has a first wall 46 which extends towards the magazine and a second wall 48 which extends from the first wall away from the magazine.

As best shown in FIG. 3, each tab has an outside relief 50 below where the tab extends from the upper element 22. A lower region 43 of each tab tapers as it extends downwardly to a foot 44. The effect is thus that the tabs 28, 30 narrow as they extend downwardly, then widen, and then narrow again as they terminate in the feet 44.

As shown in FIG. 3, the carrying device 20 serves to mount the magazine to a grid of straps, such as the Pouch Attachment Ladder System or PALS grid of webbing used to attach smaller equipment onto load bearing platforms, such as clothing, vests and backpacks, and those used in the MOLLE packs employed by the US military. A conventional PALS grid 32 has horizontal rows 34 of one-inch webbing which are spaced one-inch apart. Each web is sewn to the backing at 1.5-inch intervals to define a sequence of loops 36 which are closed sidewardly, but are open upwardly and downwardly. To connect the device 20 to the vest, the tabs 28, 30 are inserted into any two adjacent loops 36.

The tabs 28, 30 have protrusions 52 which mark the ends of the reliefs 50 and which are the widest portion of the device 20. It will be observed that the distance between the two protrusions 52 is greater than the width of two adjacent loops 36. As shown in FIG. 3, when the device 20 is inserted into the PALS grid 32, the narrow tapered regions 43 of the tabs readily are received within two adjacent PALS loops, as the device is pressed downardly, the seams 54 defining the loops engage with the outer peripheries of the tabs 28, 30, thereby urging them towards one another, and thereby narrowing the width of the device and allowing the tabs to pass through two loops 36. When fully inserted, the tab reliefs 50 are received within the loops, and the protrusions 52 are beneath the row of loops 36. In this condition, the device is secured to the PALS grid, until such time as it is desired to remove it. To remove the device 20, it is pulled upwardly, where again the tapered effect of the recesses produces a camming action which urges the tabs 28, 30 towards one another such that the device may be readily extracted, all of this can be readily accomplished with only one hand.

Thus the device at the level of the protrusions is wider than at the level of the upper recesses. When the tabs are inserted into the upwardly opening loops, portions of the first tab and the second tab are displaced, narrowing the side to side width of the device and allowing it to pass into the loops. Once the protrusions have passed beneath the loops, the device can return to substantially its original condition, enabling it to thereby engage and retain the device to the support.

It will be observed that the device is thus restricted from side to side displacement by the seams 54 which define the loops 36, from downward displacement by the upper element 22 which projects frontwardly and cannot extend through the loops; from front to back displacement by the loop itself, and from upward displacement under ordinary circumstances by the side protrusions 52.

The carrying device 20 eliminates the need for a pouch and can be lighter and less bulky than a fabric pouch. Moreover, the empty magazine need not be returned to the user's vest and may be discarded under demanding circumstances, leaving the user unencumbered by the carrying device and the spent magazine.

The carrying device 20 can also mount a magazine to a conventional belt 38, as shown in FIG. 1. When mounted to a belt 38, the tabs 28, 30, extend generally parallel to the belt, and the first walls 46 of the tab feet 44 extend beneath the belt, or else engage against a wider belt, to resiliently clamp the device in place 20. The tabs 28 are somewhat biased towards the belt, so that the feet 44 are biased against the side wall of an ammunition magazine disposed in the device. The device may also be attached directly onto the waistband of a user's pants, in which case the tabs 28, 30 will engage the pants resiliently.

Because the device 20 is as wide as the ammunition magazine itself, there is stability of the device when mounted on a user's belt. Different magazines are of different widths, and some will exceed the width of a single MOLLE loop. The two tabs of the device allow it to both offer good stability when mounted on a belt, and to extend securely into multiple MOLLE loops.

It should be noted that standard belt height is 2 inches, much taller than the 1" strap found in a MOLLE PALS array. The device 20 employs longer tabs 28, 30, which can extend across the tall belt, but employing the side to side resilience of the tabs, it can securely engage within the MOLLE loops as well.

It should be noted that, in an alternative embodiment, the tabs, rather than being fabricated of stiff plastic, may alternatively be formed of ultra thin spring steel.

Figure 5:
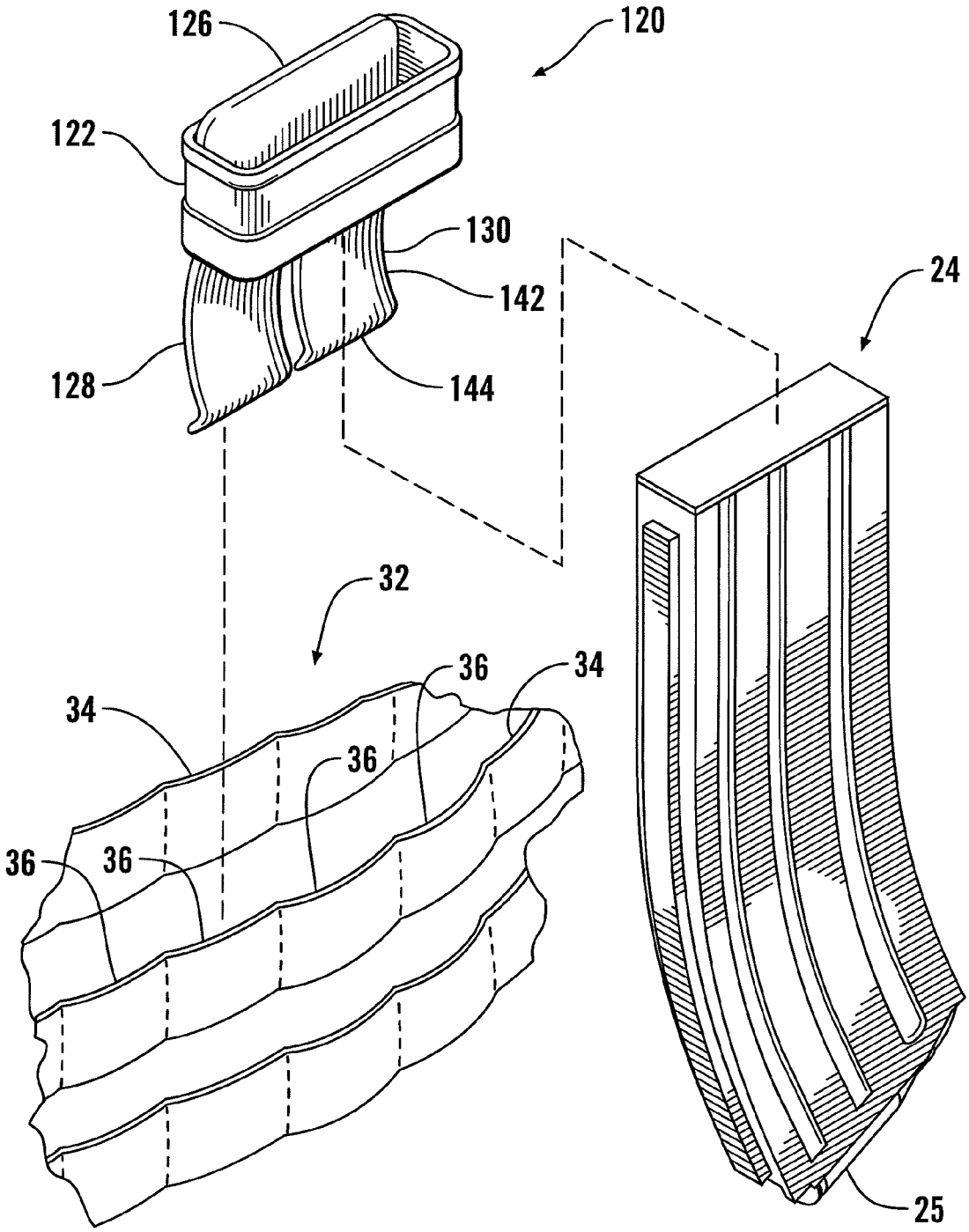
FIG. 5 is an exploded isometric view of an alternative embodiment ammunition magazine carrying device of this invention in relation to a Pouch Attachment Ladder System (PALS) vest.
Figure 6:
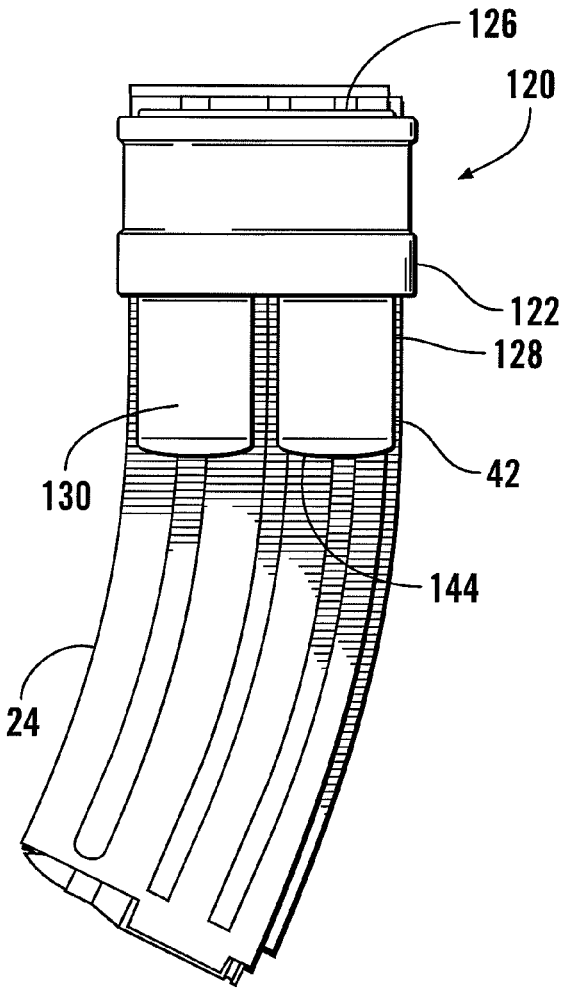
FIG. 6 is a rear elevational view of the device of FIG. 5 engaging an ammunition magazine.
Figure 7:
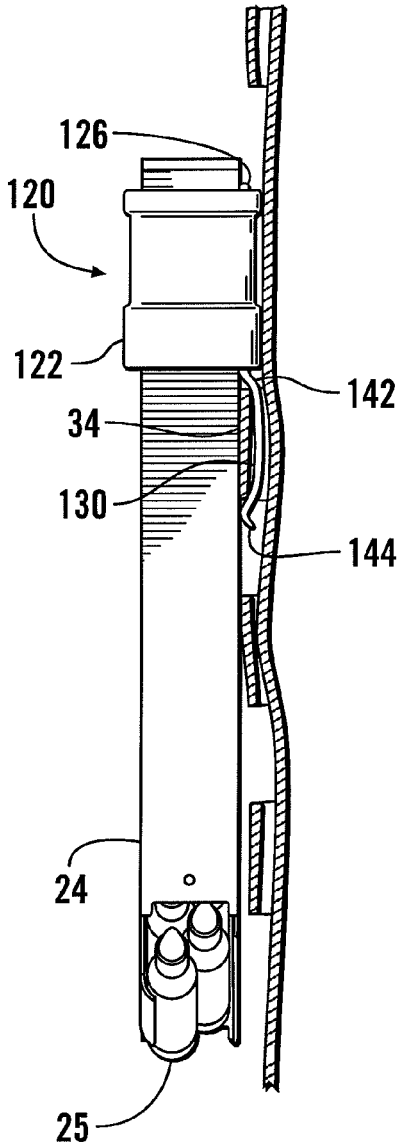
FIG. 7 is a side elevational view of the device of FIG. 5 shown engaged with a the PALS vest of FIG. 5, shown in cross-sectional view.

An alternative embodiment magazine carrying device 120 is shown in FIGS. 5-7. The device 120 has a closed elastomeric plastic band 122 which is sized to encircle and grip the ammunition magazine 24, as shown in FIGS. 6 and 7. The band 122 may be similar to the ones used by Magpul Industries Corp. of Erie, Colo., in the ORIGINAL MAGPUL® magazine enhancement. The device 120 carries the magazine 24 when filled with rounds 25 of ammunition. A rigid plastic attachment plate 126 is fixed to the elastomeric band 122, such as by adhesive, mechanical engagement, fasteners, or by co-molding. A first tab 128 extends downwardly from the attachment plate beneath the elastomeric band, and a second tab 130 extends downwardly from the plate 126 which is similar to the first tab, but spaced sidewardly from the first tab to define a downwardly extending gap between the first tab and the second tab.

As shown in FIG. 7, each tab 128, 130, has an arced main segment 142 which is concave towards the magazine, and a terminating tab foot 144 which extends away from the magazine. As shown in FIG. 6, each tab foot 144 is curved to ease the insertion of the tabs when the device 120 is attached to a carrier.

When a user wishes to replenish his weapon with an additional magazine, the magazine itself is gripped and urged upwardly to extract the tabs from engagement with the loops 36. The elastomeric band 122 is positioned sufficiently low on the magazine that the magazine may be received into feeding engagement with a weapon without interference with the band 122.

It will be observed that an important dimension for the fit of the carrying device 20 to the magazine is the circumferential size of the magazine, a dimension generally determined by the particular weapon with which the magazine is to be used. Hence, a single carrying device 20 can be fitted to a variety of different makes and capacities of magazine for the same weapon.

It should be noted that, in an alternative embodiment, the entire magazine carrying device 120 may be molded of a single polymer, or the device may be co-molded from two types of plastic, one more resilient forming the band, and one stiffer, forming the tabs. Also, the tabs, rather than being fabricated of stiff plastic, may alternatively be formed of ultra thin spring steel.

Figure 8:
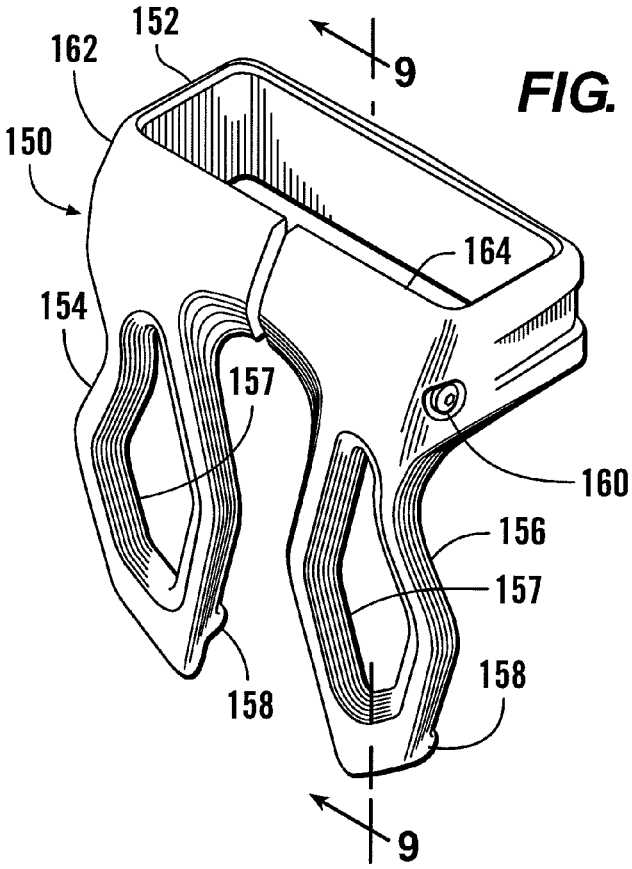
FIG. 8 is an isometric view of an alternative embodiment of the ammunition magazine carrying device of this invention.
Figure 9:
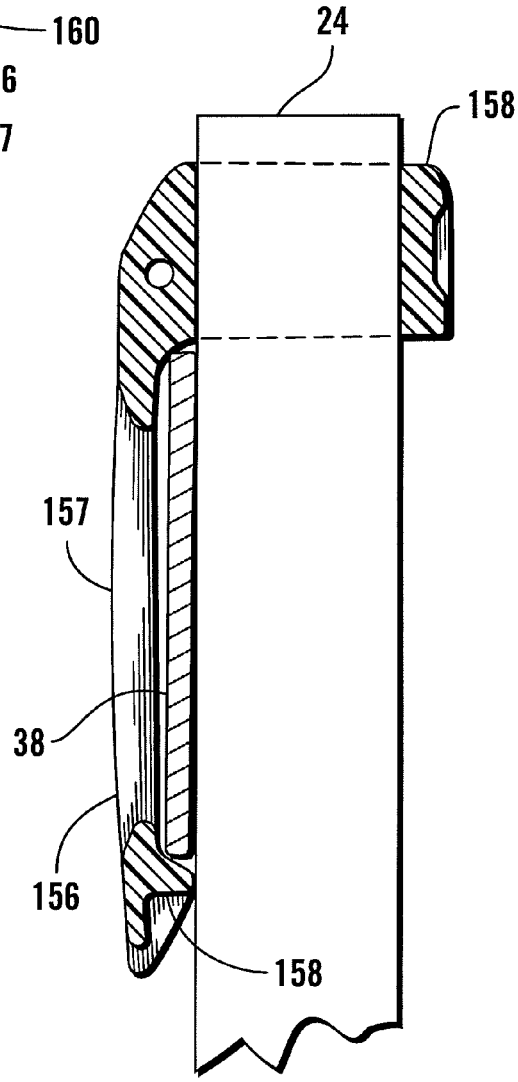
FIG. 9 is a cross-sectional view of the device of FIG. 8, taken along section 9-9, and shown attached to an ammunition magazine and mounted to a conventional waist belt.

Another alternative embodiment of the ammunition magazine carrying device 150 of the invention is shown in FIGS. 8 and 9. The device 150 has a plastic body 152 with two downwardly extending tabs 154, 156. Each tab 154, 156, is formed as a ring surrounding a central opening 157, thereby reducing the overall weight of the device, and increasing the flexibility of the tabs in the side to side direction. A flange-like protrusion 158 extends from each tab 154, 156 towards the magazine, and is positioned beneath the opening 157. The protrusions 158 extend back towards the magazine 24 on which the device 150 is mounted so as to extend beneath a standard 2-inch height belt. The tabs 154, 156 are slightly biased so as to clamp the belt between the tabs and the magazine 24. The device 150 has a fastener 160 and a clamping arrangement between a first portion 162 and a second portion 164 of the body 152, so the device may be secured to the magazine 24 in a fashion similar to the device 20.

Figure 10:
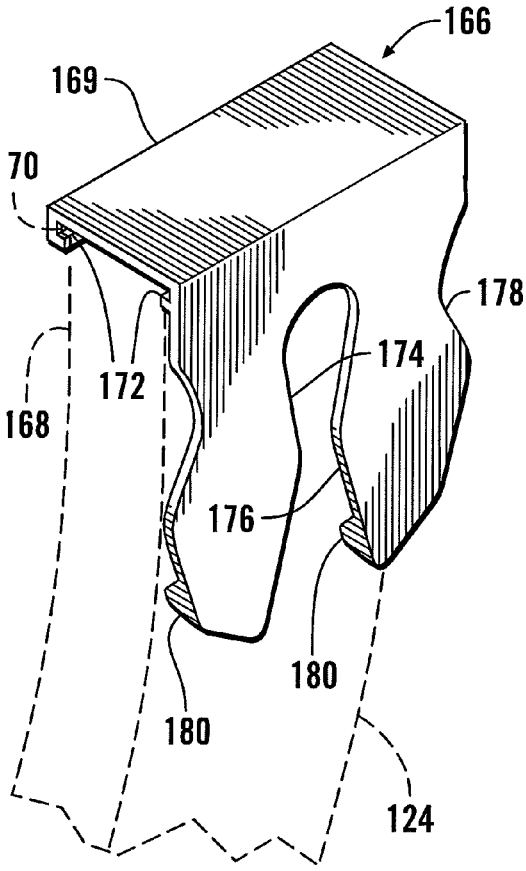
FIG. 10 is an isometric view of another alternative embodiment ammunition magazine carrying device of this invention, shown mounted to an ammunition magazine.

Another alternative embodiment ammunition magazine carrying device 166 of this invention is shown in FIG. 10, which attaches to the base of the magazine 24 by replacing the conventional base plate. Typically, the base 168 of a magazine will have a narrow flange 170 which extends frontwardly and rearwardly. The device 166 has a molded plastic top member 169 with portions defining two parallel channels 172 which receive the protruding portions of the magazine base flange 170, thereby securing the carrying device 166 to the magazine 124. The device 166 has a first tab 174 spaced across a gap 176 from a second tab 178, and each tab has a profile similar to the tabs of the device shown in FIG. 7, which offers the camming action when inserted into two side by side MOLLE loops. A flange-like protrusion or foot 180 extends from each tab 174, 176 towards the magazine. The protrusions 180 extend back towards the magazine 124 on which the device 166 is mounted so as to extend beneath a standard 2-inch height belt. The tabs are slightly biased so as to clamp the belt between the tabs and the magazine 124.

A flange-like protrusion 180 extends from each tab 174, 176 towards the magazine. The protrusions 158 extend back towards the magazine 24 on which the device 150 is mounted so as to extend beneath a standard 2-inch height belt. The tabs 174, 176 are slightly biased to clamp belts of greater height between the tabs and the magazine 124.

Figure 11:
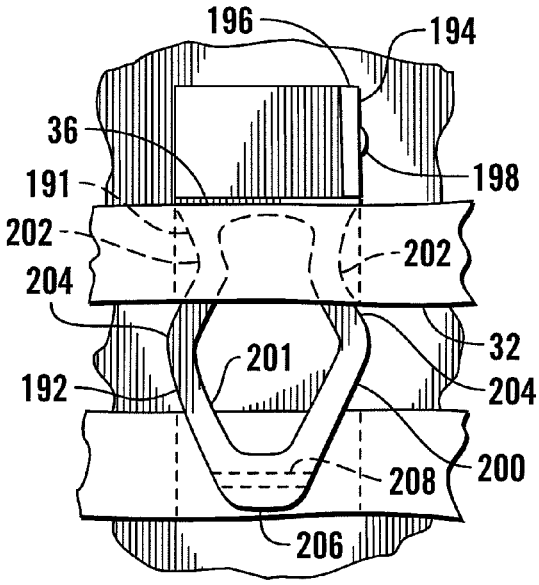
FIG. 11 is a front elevational view of another alternative embodiment ammunition magazine carrying device of this invention having a single tab and mounted within the PALS loops of a conventional MOLLE vest.

An alternative embodiment ammunition magazine carrying device 190 of this invention is shown in FIG. 11 which is adapted for a narrower magazine. The device 190 has a molded plastic body 191 with only a single tab 192 which extends downwardly from a square split ring upper element 194. The split ring upper element 194 may have a free end 196 which can be clamped to the remainder of the ring with a screw fastener 198 to clamp the device to a narrow magazine 190. The single tab 192 has a narrow frame 200 which is subject to distortion when the tab is inserted within a single MOLLE loop 36. The frame 200 surrounds a central opening 201. The single tab has two opposed upper recesses 202 positioned above two protrusions 204. Below the protrusions 204 the single tab narrows to a foot 206 with a projecting flange 208 for engagement beneath a conventional belt.

Figure 12:
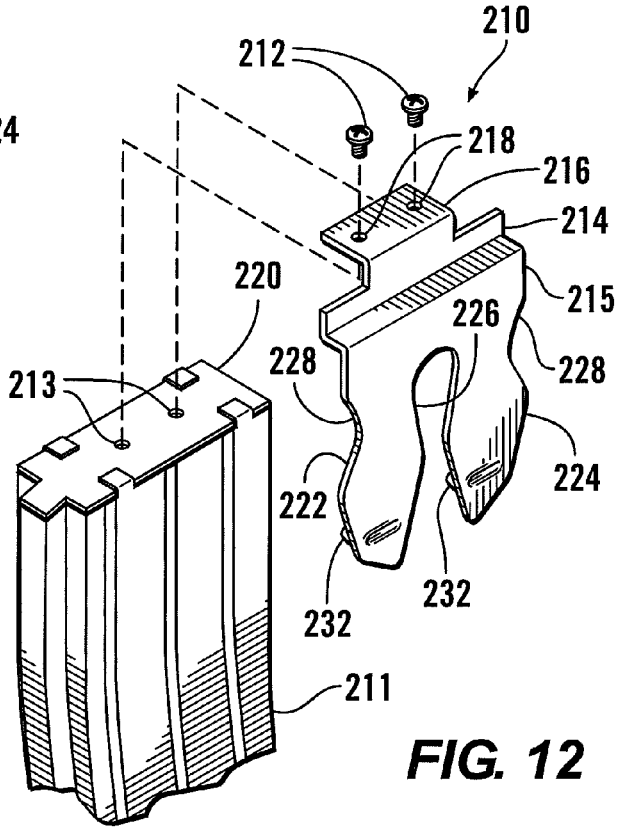
FIG. 12 is an exploded isometric view of yet another alternative embodiment ammunition magazine carrying device of this invention shown in relation to an ammunition magazine with a modified base plate.

Yet another alternative embodiment ammunition magazine carrying device 210 of this invention is shown in FIG. 12, which may be fabricated of sheet metal about 0.03" to 0.10" thick. The device 210 is used with an ammunition magazine 211 in which the conventional base plate has been replaced with a special base plate 220 having threaded mounting holes 213. The sheet metal device 210 has a main body 215 extending vertically, which is connected by a right angle connection segment 214 to a horizontal flange 216. The flange 216 has two mounting holes 218 which allow the device 210 to be mounted by fasteners 212 such as screws to the base plate 220. The main body 215 has two tabs 222, 224 on either side of a gap 226. Each tab 222, 224, has a recess 228 with a widened protrusion therebelow. The tabs 222, 224 narrow towards a foot 230, which may have a stamped extension 232 which serves to engage below a belt when the device is mounted to a conventional belt.

It is understood that the invention is not limited to the particular construction and arrangement of parts herein illustrated and described, but embraces all such modified forms thereof as come within the scope of the following claims.

I claim:

1. A device for mounting an ammunition magazine to a support, the device comprising:

an elastomeric upper element arranged to encircle said ammunition magazine, the upper element defining a lower opening through which the magazine can extend or be accessed, wherein the upper element has portions which engage and grip the magazine;

a rigid attachment plate fixed to the upper element, 1*a* first tab extending downwardly from the attachment plate; and a second tab extending downwardly from the attachment plate and spaced sidewardly from the first tab to define a downwardly extending gap between the first tab and the second tab, to permit the tabs to be received within two adjacent upwardly opening pockets, wherein the first tab and the second tab each have an arced main segment which is concave towards the magazine, and terminates in a projecting tab foot which extends away the magazine.

2. A device for mounting an ammunition magazine to a support comprised of a belt or an upwardly opening loop, the device comprising:

an upper element arranged to engage said ammunition magazine; and a first tab extending downwardly from the upper element; and a second tab extending downwardly from the upper element and spaced sidewardly therefrom to define a downwardly opening gap therebetween, the first tab and the second tab having portions which extend towards the ammunition magazine when the device is mounted thereto, to engage a belt between, the ammunition magazine and the tabs, and wherein the first tab and the second tab are deflectable towards each other to allow the first tab and the second tab to enter within two adjacent upwardly opening loops, the total width of the two adjacent loops being less than the total width of the undeflected tabs, and downward pressure on the tabs into the loops serving to deflect the tabs towards one another to allow portions of the tabs to pass through the loops and extend beneath the loops; wherein the device is formed of sheet metal, for attachment to the baseplate of an ammunition magazine having at least one receiving hole therein, and wherein the upper element comprises a horizontal flange having at least one fastener extending therethrough into said receiving hole to connect the horizontal flange to the ammunition magazine baseplate.

3. A device for mounting an ammunition magazine to a support, the device comprising:

an upper element arranged to encircle said ammunition magazine, the upper element defining a lower opening through which the magazine can extend or be accessed, wherein the upper element has portions which engage and grip the magazine;

a first tab extending downwardly from the upper element; and a second tab extending downwardly from the upper element and spaced sidewardly from the first tab to define a downwardly extending gap between the first tab and the second tab, to permit the tabs to be received within two adjacent upwardly opening pockets, wherein the first tab has a main segment which extends downwardly from the upper element, and wherein the second tab has a main segment which extends downwardly from the upper element, the main segments having outside edges, and wherein the first tab and second tab are bendable towards each other to reduce the distance between the tab main segment outside edges to allow the first tab and second tab to be inserted within two adjacent upwardly opening loops; and wherein the tab main segment terminates in a foot having a first wall which protrudes from the main segment towards the magazine, the first wall having portions which face towards the upper element to be positioned to engage beneath a belt.

4. The device of claim 3 wherein the tab foot has a second wall which extends from the first wall away from the magazine.

5. A device for mounting an ammunition magazine to a support, the device comprising:

an upper element arranged to encircle said ammunition magazine, the upper element defining a lower opening through which the magazine can extend or be accessed, wherein the upper element has portions which engage and grip the magazine;

a first tab extending downwardly from the upper element, and having a main segment which extends downwardly from the upper element, the main segment having an outside edge which defines an upper recess positioned beneath the main element, and a protrusion beneath the upper recess, and wherein the first tab main segment narrows beneath the protrusion, such that the first tab main segment at the level of the protrusion is wider than at the level of the upper recess; and a second tab extending downwardly from the upper element and spaced sidewardly from the first tab to define a downwardly extending gap between the first tab and the second tab, to permit the tabs to be received within two adjacent upwardly opening pockets, the first tab and the second tab being integrally formed in one piece with the upper element.

6. The device of claim 5 wherein the portions of the upper element which engage and grip the magazine comprise an encircling split ring having a first portion defining a first end which is spaced from a second end of a second portion; wherein the tabs extend downwardly from, these portions, and wherein a fastener extends between the ring first portion and the second portion, the fastener being adjustable to clamp the magazine within the ring.

7. The device of claim 5 wherein the first tab has a main segment which extends downwardly from the upper element, and wherein the second tab has a main segment which extends downwardly from the upper element, the main segments having outside edges, and wherein the first tab and second tab are bendable towards each other to reduce the distance between the tab main segment outside edges to allow the first tab and second tab to be inserted within two adjacent upwardly opening loops.

8. The device of claim 7 wherein the first tab and the second tab decrease in width as they extend downwardly from a protrusion, such that the decreased width portions of the tabs are receivable within upwardly opening loops on the support, further downward motion of the tabs into the loops causing the tabs to displace towards one another until the protrusions have passed through and extend beneath the loops.

9. The device of claim 7 wherein each tab main segment has an outside relief below where the tab extends from the upper element, such that the tabs narrow as they extend downwardly, then widen at a protrusion, and then narrow again as they terminate in feet, such that where the distance between the two protrusions is wider than the width of two adjacent loops in a carrier, the tabs may be urged towards one another, narrowing the width of the device and allowing the tabs to pass through said two loops, and when fully inserted, the tab reliefs are received within the loops, and the protrusions are beneath the loops.

10. A device for mounting an ammunition magazine to a support, the device comprising:

an upper element arranged to engage said ammunition magazine; and a first tab extending downwardly from the upper element, the first tab having a main segment which extends downwardly from the upper element, the main segment having an outside edge which defines an upper recess positioned beneath the main element, and a protrusion beneath the upper recess, and wherein the first tab main segment narrows beneath the protrusion, such that the device at the level of the protrusion is wider than at the level of the upper recess, portions of the first tab being displaced when the tab is inserted into a narrow upwardly opening loop on the support, and returning to substantially its original condition when the protrusion has passed below the loop, to thereby engage and retain the device to the support; and wherein the first tab main segment terminates in a foot having a first wall which protrudes from the main segment towards the magazine, the first wall having portions which face towards the upper element to be positioned to engage beneath a belt.

11. The device of claim 10, wherein the upper element comprises a split ring, having a first portion defining a first end which is spaced from a second end of a second portion, and wherein a fastener extends between the ring first portion and the second portion, and being adjustable to clamp the magazine within the ring.

12. The device of claim 10, further comprising a second tab extending downwardly from the upper element and spaced sidewardly from the first tab to define a downwardly extending gap between the first tab and the second tab, to permit the tabs to be received within two adjacent upwardly opening loops, wherein the second tab has a main segment which extends downwardly from the upper element, the first tab and second tab main segments having outside edges, and wherein the first tab and second tab are bendable towards each other to reduce the distance between the tab main segment outside edges to allow the first tab and second tab to be inserted within two adjacent upwardly opening loops.

13. The device of claim 10 wherein the first tab main segment comprises a frame surrounding a central opening, the frame having two opposed upper recesses positioned above two protrusions, the frame being subject to distortion when the first tab is inserted within a single upwardly opening loop on the support.

14. An assembly of a load bearing platform and a device mounting an ammunition magazine to the platform, the assembly comprising:

a load bearing platform having two adjacent upwardly opening loops;

an ammunition magazine; and a mounting device having an upper element which engages said ammunition magazine; a first tab extending downwardly from the upper element; and a second tab extending downwardly from the upper element and spaced sidewardly therefrom to define a downwardly opening gap therebetween, the first tab and the second tab having portions which extend towards the ammunition magazine, and wherein the first tab and the second tab are deflectable towards each other to allow the first tab and the second tab to enter within the two adjacent upwardly opening loops, the total width of the two adjacent loops being less than the total width of the undeflected tabs, and downward pressure on the tabs into the loops serving to deflect the tabs towards one another to allow portions of the tabs to pass through the loops and extend beneath the loops.

15. The device of claim 14, wherein the upper element comprises a split ring, having a first portion defining a first end which is spaced from a second end of a second portion, and wherein a fastener extends between the ring first portion and the second portion, and being adjustable to clamp the magazine within the ring.

16. The device of claim 14 wherein the first tab and the second tab have main segments comprised of a frame surrounding a central opening, each frame having an upper recess positioned above a protrusion, the frames being subject to distortion when inserted within upwardly opening loops on the support.

17. The device of claim 14 wherein the upper element has portions defining parallel channels which face each other to receive the flange of the ammunition magazine.

18. A device for mounting an ammunition magazine to a support, the device comprising:

an upper element arranged to encircle said ammunition magazine, the upper element defining a lower opening through which the magazine can extend or be accessed, wherein the upper element has portions which engage and grip the magazine, wherein the portions of the upper element which engage and grip the magazine comprise an encircling split ring having a first portion defusing a first end which is spaced from a second end of a second portion;

a first tab extending downwardly from the upper element first portion adjacent the first end;

a second tab extending downwardly from the upper element second portion adjacent the second end; and spaced sidewardly from the first tab to define a downwardly extending gap between the first tab and the second tab, to permit the tab to be received within two adjacent upwardly opening pockets, the first tab and the second tab being integrally formed in one piece with the upper element; and a fastener which extends between the ring first portion and the second portion, the fastener being adjustable to clamp the magazine within the ring.

* * * * *

UNITED STATES PATENT AND TRADEMARK OFFICE

CERTIFICATE OF CORRECTION

PATENT NO. : 8,485,405 B2
APPLICATION NO. : 12/906657
DATED : July 16, 2013
INVENTOR(S) : Caleb Clark Crye It is certified that error appears in the above-identified patent and that said Letters Patent is hereby corrected as shown below:

In the Claims:

Column 6, in Claim 1, line 51, "to the upper element, 1a first" should be --to the upper element, a first--.

Column 10, in Claim 18, line 28, "having a first portion defusing a" should be --having a first portion defining a--.

Signed and Sealed this
Tenth Day of September, 2013

Teresa Stanek Rea
*Acting Director of the United States Patent and Trademark Office*